US007070430B2

(12) United States Patent
Yang et al.

(10) Patent No.: US 7,070,430 B2
(45) Date of Patent: Jul. 4, 2006

(54) ELECTRICAL CARD CONNECTOR HAVING AN EJECT MECHANISM

(75) Inventors: Meng Huan Yang, Tu-chen (TW); Tien-Chieh Su, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,483

(22) Filed: Dec. 28, 2004

(65) Prior Publication Data

US 2005/0186817 A1 Aug. 25, 2005

(30) Foreign Application Priority Data

Feb. 20, 2004 (CN) ..... 2004 2 00248812

(51) Int. Cl.
*H01R 13/62* (2006.01)

(52) U.S. Cl. ..... 439/159; 439/630

(58) Field of Classification Search ..... 439/59, 439/152, 157, 159, 372, 629, 630
See application file for complete search history.

(56) References Cited

U.S. PATENT DOCUMENTS

| | | | | |
|---|---|---|---|---|
| 6,648,694 | B1 * | 11/2003 | Takamori et al. | 439/630 |
| 6,729,892 | B1 * | 5/2004 | Takada et al. | 439/159 |
| 6,761,569 | B1 * | 7/2004 | Nakamura | 439/159 |
| 6,816,386 | B1 * | 11/2004 | Oguchi et al. | 361/769 |
| 2001/0055896 | A1 | 12/2001 | Takada et al. | |
| 2005/0221649 | A1 * | 10/2005 | Tanaka et al. | 439/159 |

* cited by examiner

*Primary Examiner*—Thanh-Tam Le
(74) *Attorney, Agent, or Firm*—Wei Te Chung

(57) ABSTRACT

An electrical card connector (100) is provided for electrically connecting with an electrical card (9) defining a notch (90) and includes a cover (1), a number of conductive contacts (2) and an eject mechanism. The eject mechanism includes a heart cam element (51) defining a heart-shaped guiding groove (510), a slider (52), a cam follower (53) having a clap (533) and a pair of coiled springs (54) disposed between the heart cam element and the slider. The cam follower has an end connecting with the slider and an opposite end moving in the guiding groove of the heart cam element. When the electrical card is inserted into the electrical card connector, the clasp of the cam follower is displaced into the notch of the card. When the card is ejected from the connector, the clasp disengages from the connector.

10 Claims, 9 Drawing Sheets

ELECTRICAL CARD CONNECTOR HAVING AN EJECT MECHANISM

BACKGROUND OF THE INVENTION

1. Field of the Invention

The present invention generally relates to a card connector mounted on an electronic device, and more particularly to a connector with a compact structure for reliably holding an inserted electrical card.

2. Description of the Prior Art

Generally, in conventional electrical card connector, many card connector have an eject mechanism to remove the inserted card from the connector. A related conventional card connector is disclosed in U.S. patent application Publication No. 2001/0055896A1. The conventional electrical card connector includes a cover, a plurality of conductive contacts and an eject mechanism. The eject mechanism comprises a heart cam element defining a guiding groove, a slider, a cam follower disposed between the guiding groove of the heart cam element and the slider, a coiled spring and a latching member. The coiled spring is disposed between the slider and the cover for providing enough elastic force. The latching member has an end fixing with the slider and an opposite end forming a hook for engaging with a notch of an electrical card and a protrusion portion upwardly extending into a guide hole of the cover. When the electrical card is inserted into the connector, the slider moves with the movement of the card. At the same time, the hook of the latching member engages with the notch of the card to prevent the card from falling out of the connector. When the card is ejected from the connector, the latching member disengages from the notch of the card, thereby free the card from the connector. However, the conventional connector need an additional latching member, as a result, the conventional connector includes more excessive components to make the eject mechanism complex.

Hence, an improved electrical card connector having a simplified structure is needed to solve the above problems.

BRIEF SUMMARY OF THE INVENTION

A main object of the present invention is to provide an electrical card connector which is capable of reliably holding an inserted card in a compact mechanism.

In order to attain the object above, an electrical card connector for electrically connecting with an electrical card defining a notch includes a cover, a plurality of conductive contacts and an eject mechanism. The eject mechanism includes a heart cam element defining a heart-shaped guiding groove, a slider, a cam follower having a clap and a pair of coiled springs disposed between the heart cam element and the slider. The cam follower has an end connecting with the slider and an opposite end move in the guiding groove of the heart cam element. When the electrical card is displaced into the electrical card connector, the clasp of the cam follower is inserted into the notch of the card. When the card is ejected from the connector, the clasp disengages from the connector.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
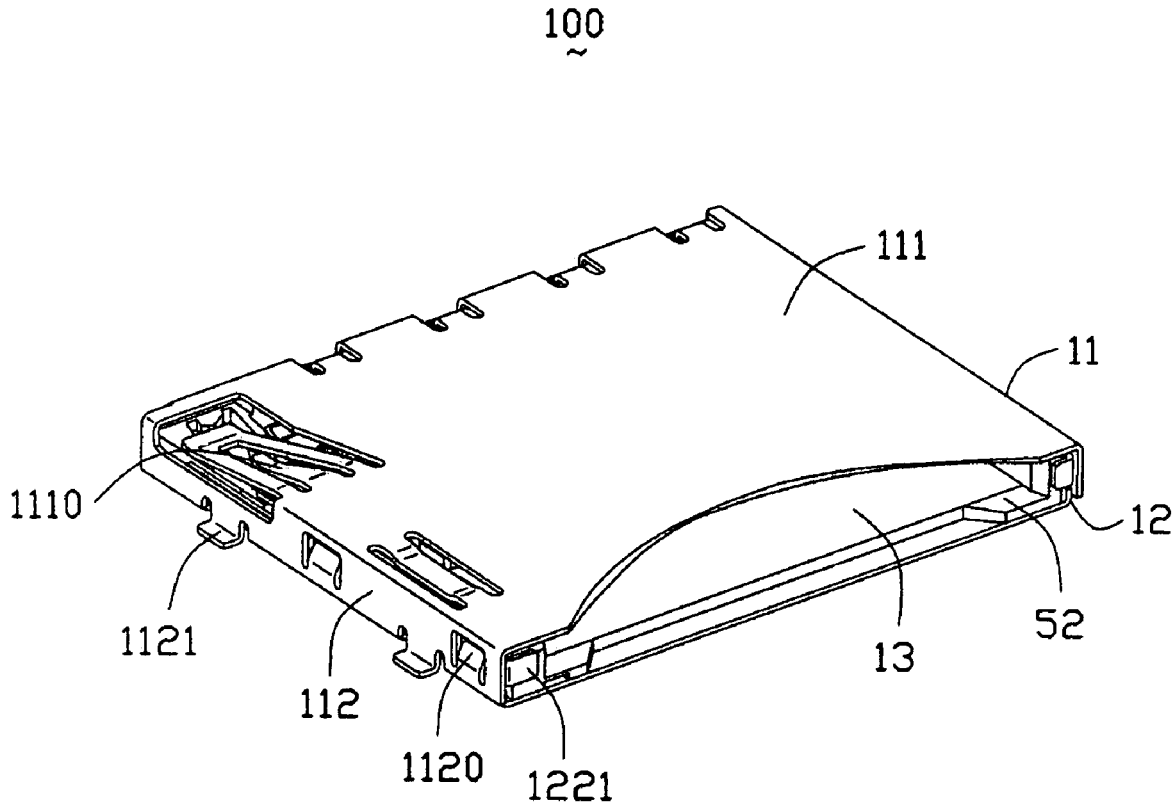
FIG. 1 is a perspective view of an electrical card connector of the present invention.
Figure 2:
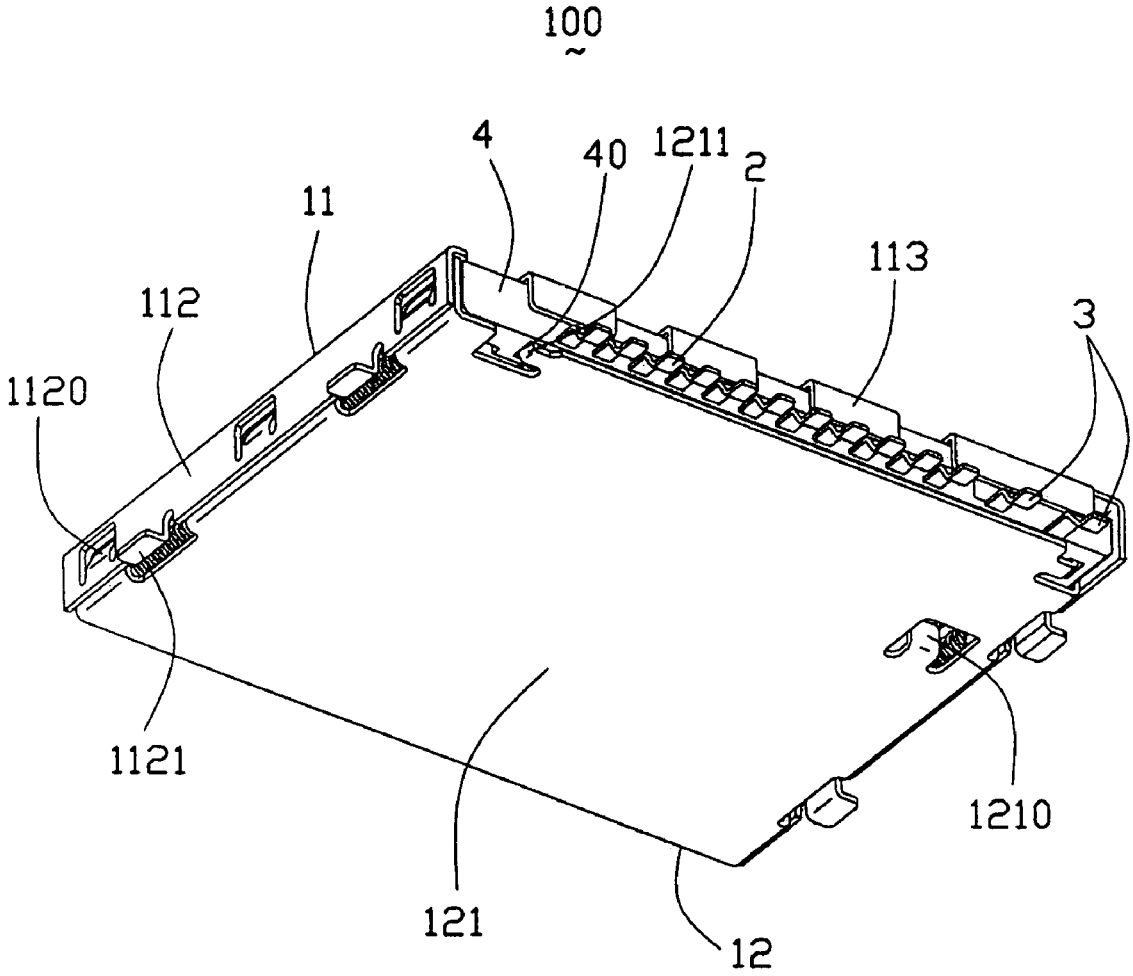
FIG. 2 is a similar view of FIG. 1, but from another perspective view.
Figure 3:
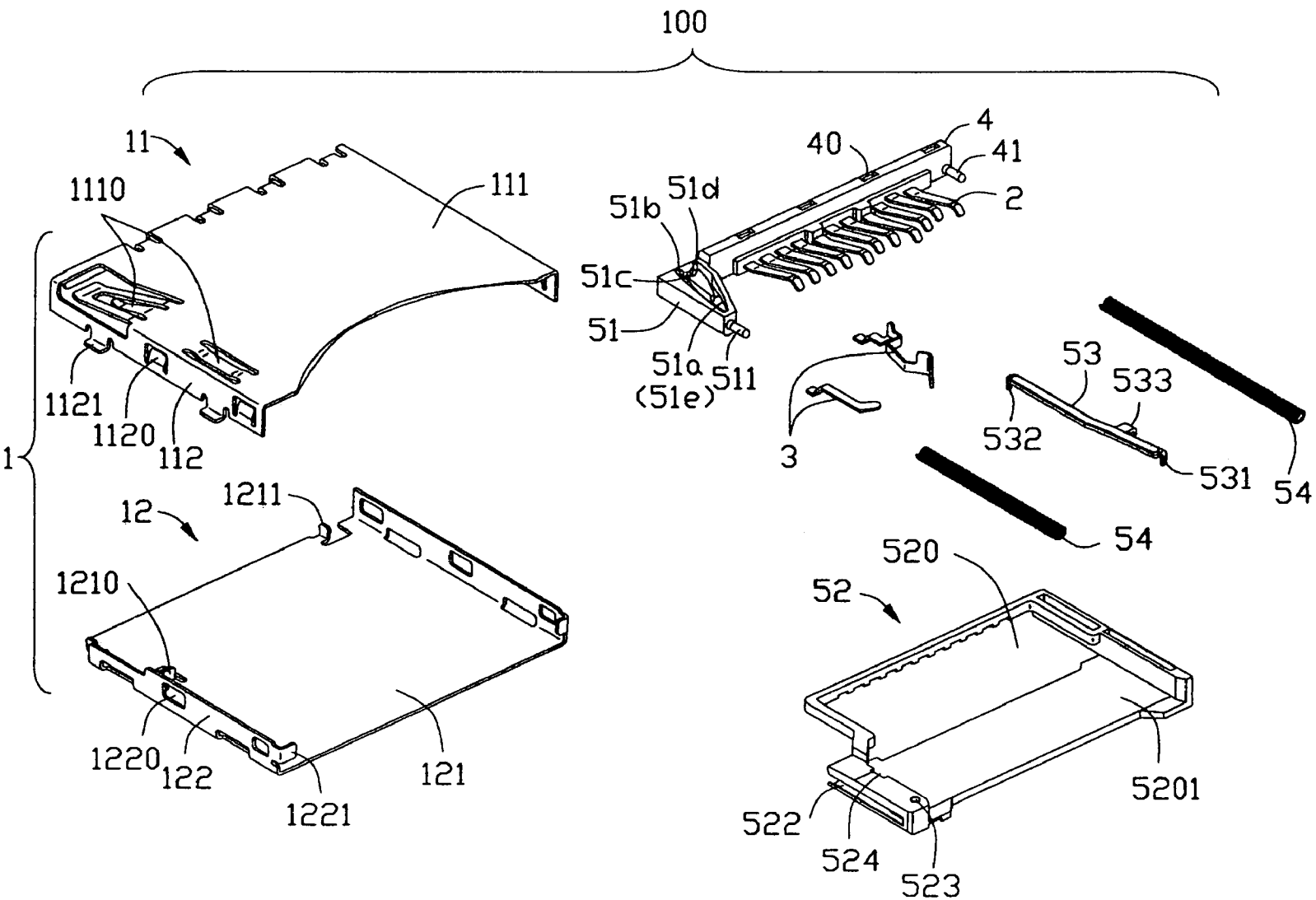
FIG. 3 is an exploded view of the electrical card connector.
Figure 4:
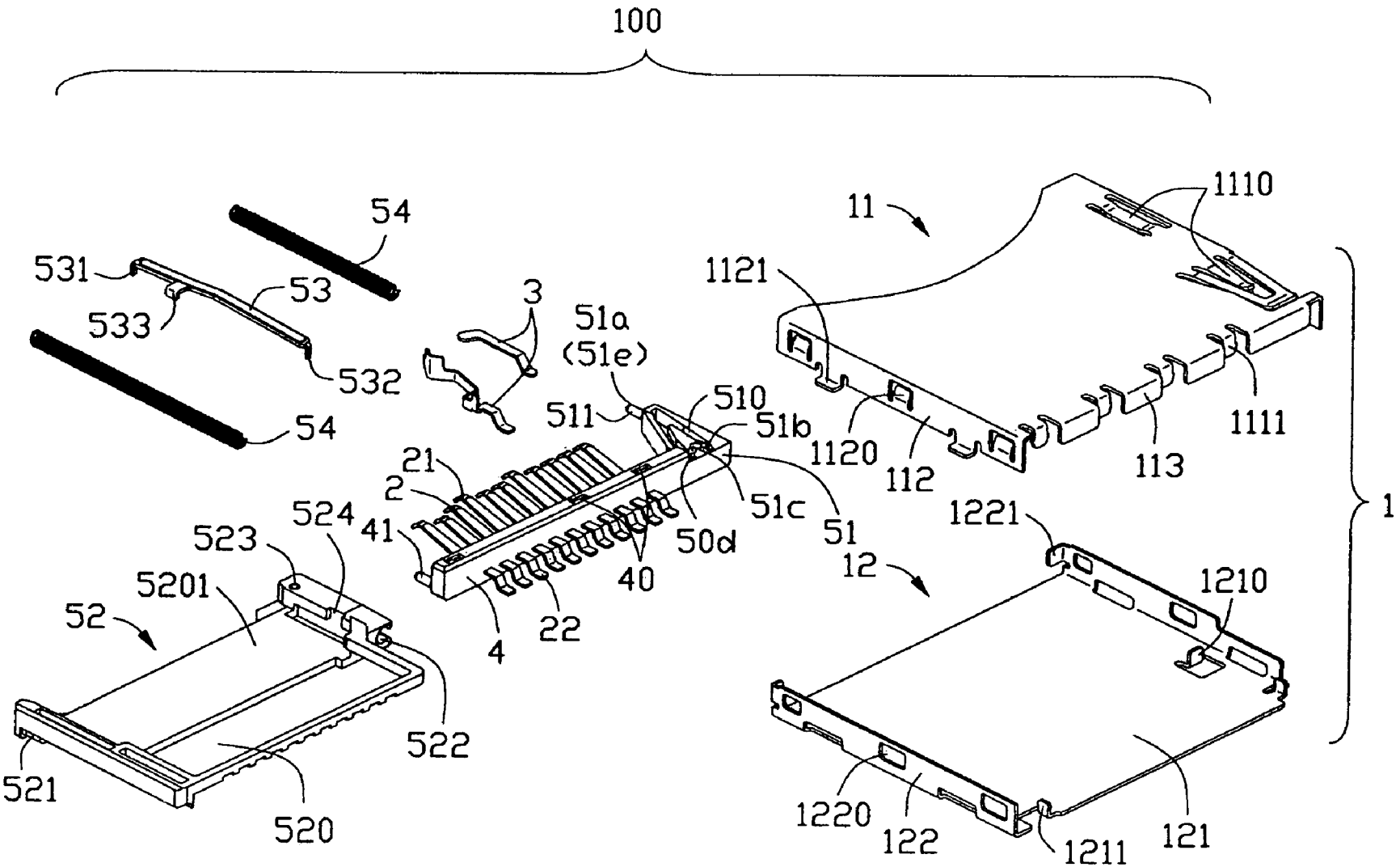
FIG. 4 is a similar view of FIG. 3, but from another perspective view.
Figure 5:
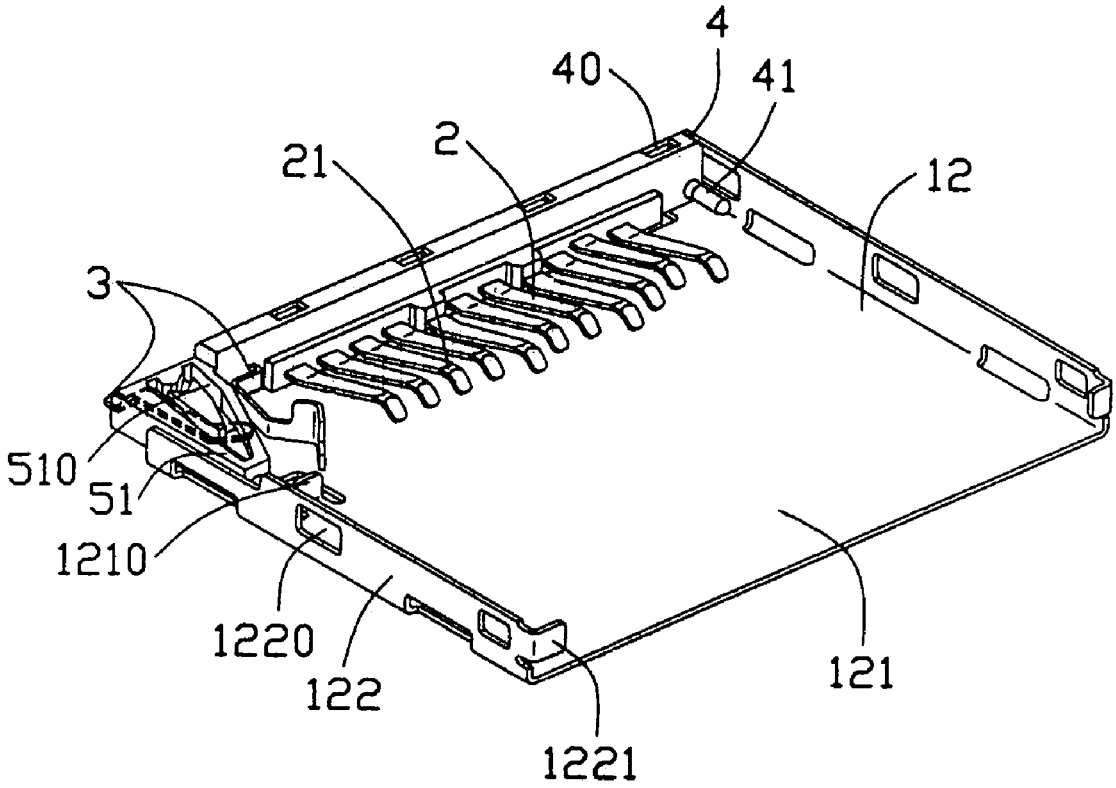
FIG. 5 is a partially assembled view of the electrical card connector.
Figure 6:
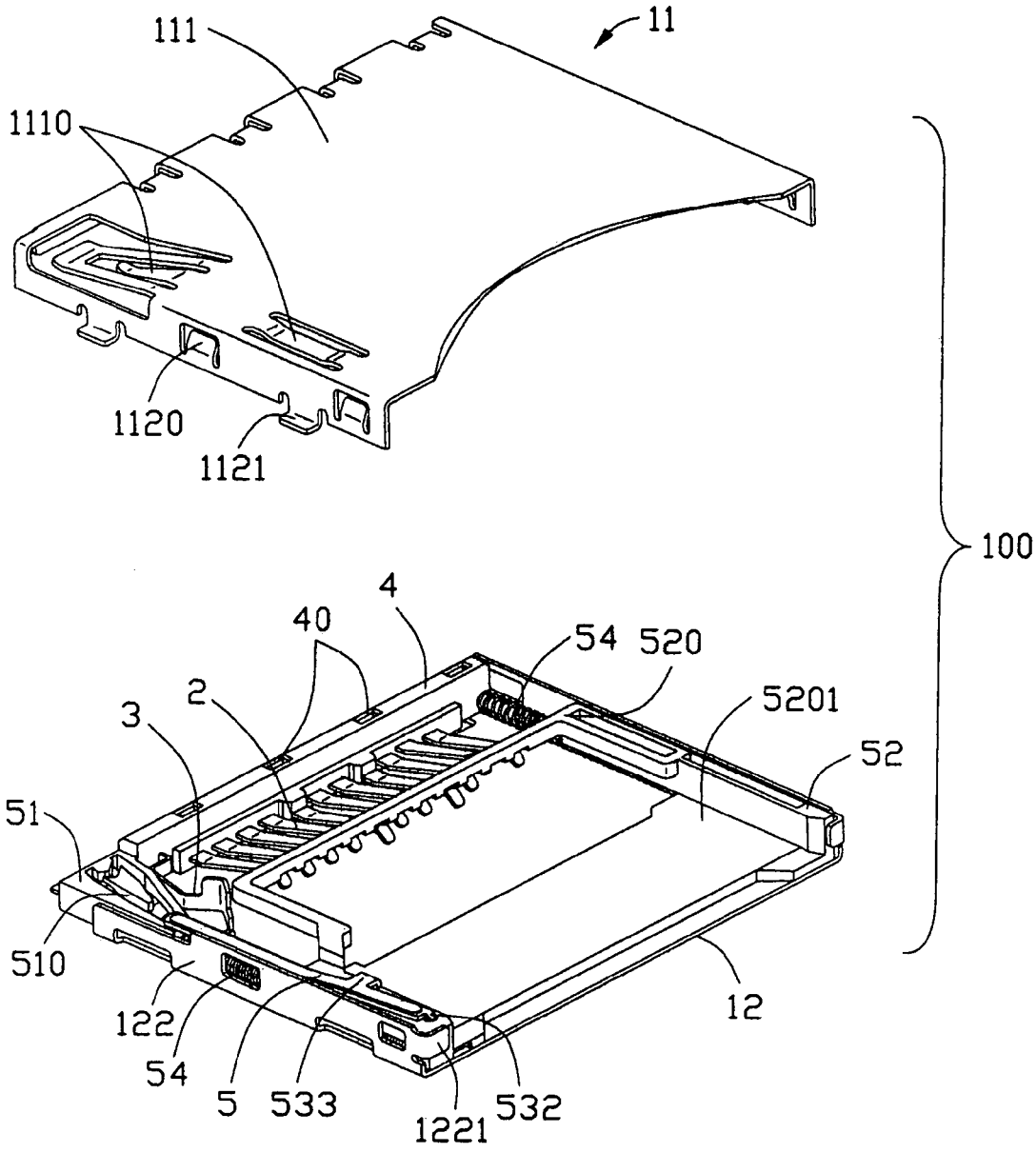
FIG. 6 is a partially exploded view of the electrical card connector.

Reference will now be made to the drawing figures to describe the present invention in detail.

Referring to FIGS. 1–4, an electrical connector 100 for electrically connecting with an electrical card 9 (shown in FIG. 7) according to the present invention includes a cover 1, a plurality of conductive contacts 2, a pair of detect contacts 3, a fixing member or insulative housing 4 provided for supporting the conductive contacts 2, the detect contacts 3 and an eject mechanism (not labeled). The eject mechanism comprises a heart cam element 51, a slider 52, a cam follower 53 and a pair of coiled springs 54. The cover 1 cooperates with the fixing member 4 to receive the eject mechanism and the electrical card 9.

The cover 1 includes a top plate 11 and a bottom plate 12. The top plate 11 includes a top wall 111, a pair of first sidewalls 112 and a rear wall 113. The top wall 111 forms a pair of leaf springs 1110 for abutting against the eject mechanism in one side thereof (as described in detail hereinafter). The top wall 111 further includes a number of first securing fingers 1111 downwardly bending from partial rear edge thereof. The first sidewalls 112 forms a number of locking tabs 1120 interiorly bending therefrom and a plurality of flanges 1121 transversely extending from a bottom edge thereof for fixing the electrical card connector 100 to an external equipment (not shown). The bottom plate 12 includes a bottom wall 121 and a pair of second sidewalls 122. The bottom wall 12 forms a stopping flap 1210 upwardly bending from the same side thereof as the leaf springs 1111 of the top wall 111 and a pair of second securing fingers 1211 upwardly bending from opposite sides of a rear edge thereof. The second sidewalls 122 define a plurality of openings 1220 for engaging with corresponding locking tabs 1120 of the first sidewalls 112 of the top plate 11. The second sidewalls 122 further form a pair of resistance tabs 1221 bending toward each other in front edges thereof. In addition, the top plate 11 cooperates with the bottom plate 12 to forms a receiving space 13 for receiving the electrical card 9.

The conductive contacts 2 are retained in the fixing member 4 and each comprises a contacting portion 21 for electrically connecting with the electrical card 9 and a soldering portion 22 rearward extending from the contacting portion 21. The detect contacts 3 are similar to the conductive contacts 2 and each includes a contacting portion (not labeled) and a soldering portion (not labeled). In the present invention, the soldering portions 22 of the conductive contacts 2 and the soldering portions of the detect contacts 3 electrically connect with a printed circuit board (not shown) through soldering method.

The fixing member 4 is substantially longitudinal and defines a plurality of recesses 40 in a top and bottom surface thereof for engaging with the first securing fingers 1111 and the second securing fingers 1211. The fixing member 4 further forms a first post 41 forwarding projecting from a front portion of one side thereof.

Referring to FIGS. 3–7, the eject mechanism comprises the heart cam element 51, the slider 52, the cam follower 53 and the coiled springs 54. The heart cam element 51 is integrated with the fixing member 4 and positioned in opposite side of the first post 41. The heart cam element 51 defines a heart-shaped guiding groove 510 therein. The heart-shaped guiding groove 510 includes an initiative point 51*a*, a first transition point 51*b*, a middle point 51*c*, a second transition point 51*d* and a terminate point 51*e* equal in the initiative point 51*a*. The heart cam element 51 further forms a second post 511 forwardly projecting from a front portion thereof.

The slider 52 is substantially a flat and includes a main portion 520 defining a receiving room 5201 for accommodating the electrical card 9, and further includes on a front portion a comb structure defining a plurality of aligning slots therein to respectively receive corresponding contacts 2 when said slider 52 is moved together with the card 9 and the cam follower 53 in said insertion direction. The main portion 520 forms a third post 521 in the same side as the first post 41 of the fixing member 4 and defines a receiving channel 522 in another side corresponding to the second post 511 of the heart cam element 51. At the same time, the slider 52 defines an orientation hole 523 in a top surface in the same side as the receiving channel 522 and a recess 524 adjacent to the receiving room 5201.

The cam follower 53 is substantially strip and forms a first hook 531 and a second hook 532 downwardly bending from opposite ends thereof. The cam follower 53 forms a clasp 533 interiorly projecting from a substantially middle portion thereof for latching with a notch 90 of the electrical card 9, thereby securely fixing the electrical card 9 in the electrical connector 100 (shown in FIGS. 7–9). The first hook 531 is inserted into the orientation hole 523 of the slider 52 to connect each other, while the second hook 532 can move in the guiding groove 510 of the heart cam element 51.

The coiled springs 54 give the slider 52 elastic force to realize eject the electrical card 9 from the electrical card connector 100. One of the coiled springs 54 is disposed between the first post 41 of the fixing member 4 and the third post 521 of the slider 52, while the other is disposed between the second post 511 of the heart cam element 51 and the receiving channel 522 of the slider 52.

Referring to FIGS. 1–6, in assembly, firstly the fixing member 4 is assembled in the bottom plate 12. The second securing fingers 1211 of the bottom plate 12 are inserted into the corresponding recesses 40 of the fixing member 4 (shown in FIG. 2). The contacting portions 21 of the conductive contacts 2 and the contacting portion of the detect contacts 3 are positioned in the bottom wall 121 of the bottom plate 12 (shown in FIG. 5). Secondly, the eject mechanism is assembled with the bottom plate 12 and the fixing member 4. The slider 52 is positioned on the bottom wall 121 of the bottom plate 12. One of the coiled springs 54 is disposed between the first post 41 of the fixing member 4 and the third post 521 of the slider 52. Another coiled spring 54 is disposed between the second post 511 of the heart cam element 51 and the receiving channel 522 of the slider 52. The slider 52 is movable between the stop flaps 1210 of the bottom wall 121 and the resistant tabs 1221 of the sidewalls 122 of the bottom plate 12. The first hook 531 of the cam follower 53 is inserted into the orientation hole 523 of the slider 52 to connect with the slider 52, while the second hook 532 of the cam follower 53 is received in the heart-shaped guiding groove 510 of the heart cam element 51 and is movable with the movement of the slider 52. As a result, the clasp 533 of the cam follower 53 has a determinate degree movement in a left-to-right direction along with the slider 52 movable. Finally, the top plate 11 is assembled in the bottom plate 12 with the first securing fingers 1111 being inserted into the recesses 40 of the fixing member 4. The locking tabs 1120 of the top plate 11 engage with the openings 1220 of the sidewalls 122 of the bottom plate 12. The rear wall 113 of the top plate 11 encloses the rear portion of the fixing member 4 (shown in FIGS. 1–2). The conductive contacts 2 and the detect contacts 3 are retained in the receiving space 13 forming by the top and bottom plates 11, 12. The leaf springs 1110 abut against the eject mechanism to prospect the eject mechanism damage or falling out of the connector 100. Then, the electrical connector 100 is mounted on the printed circuit board with the flange 1121 of the top plate 11 being retained in the printed circuit board, thereby the soldering portions 22 of the conductive contacts 2 and the soldering portions of the detect contacts 3 electrically connecting with the printed circuit board. In a normal state (shown in FIG. 7), the slider 52 abuts against the resistance tabs 1221 of the bottom plate 12 via the elastic force of the coiled springs 54. The second hook 532 of the cam follower 53 is positioned in the initiative point 51*a* of the guiding groove 510 of the heart cam element 51 and the clasp 533 is positioned in recess 524 of the slider 52.

Figure 7:
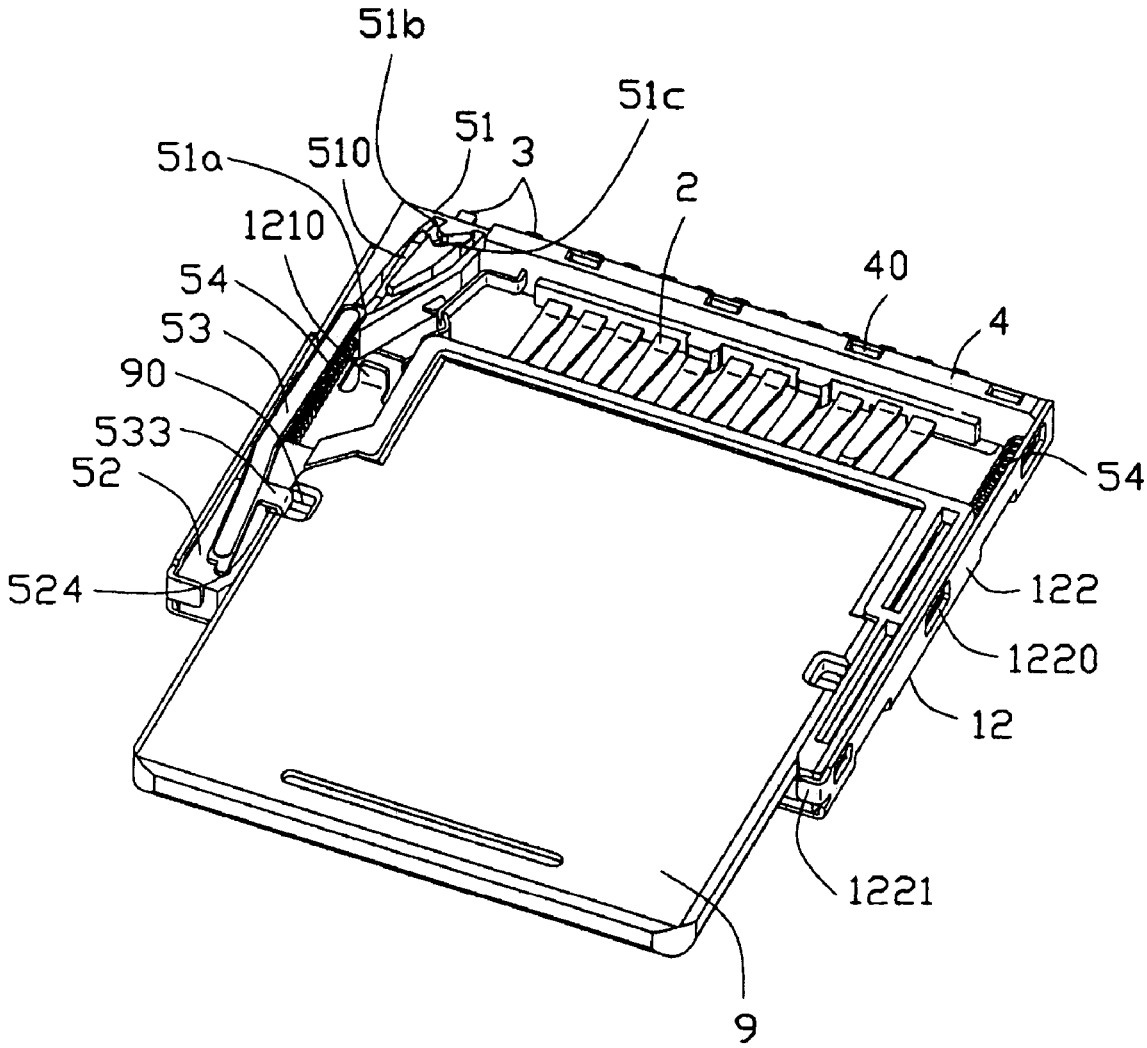
FIG. 7 is a perspective view of the electrical card connector with an electrical card inserted before the electrical card being fully inserted into the connector.
Figure 8:
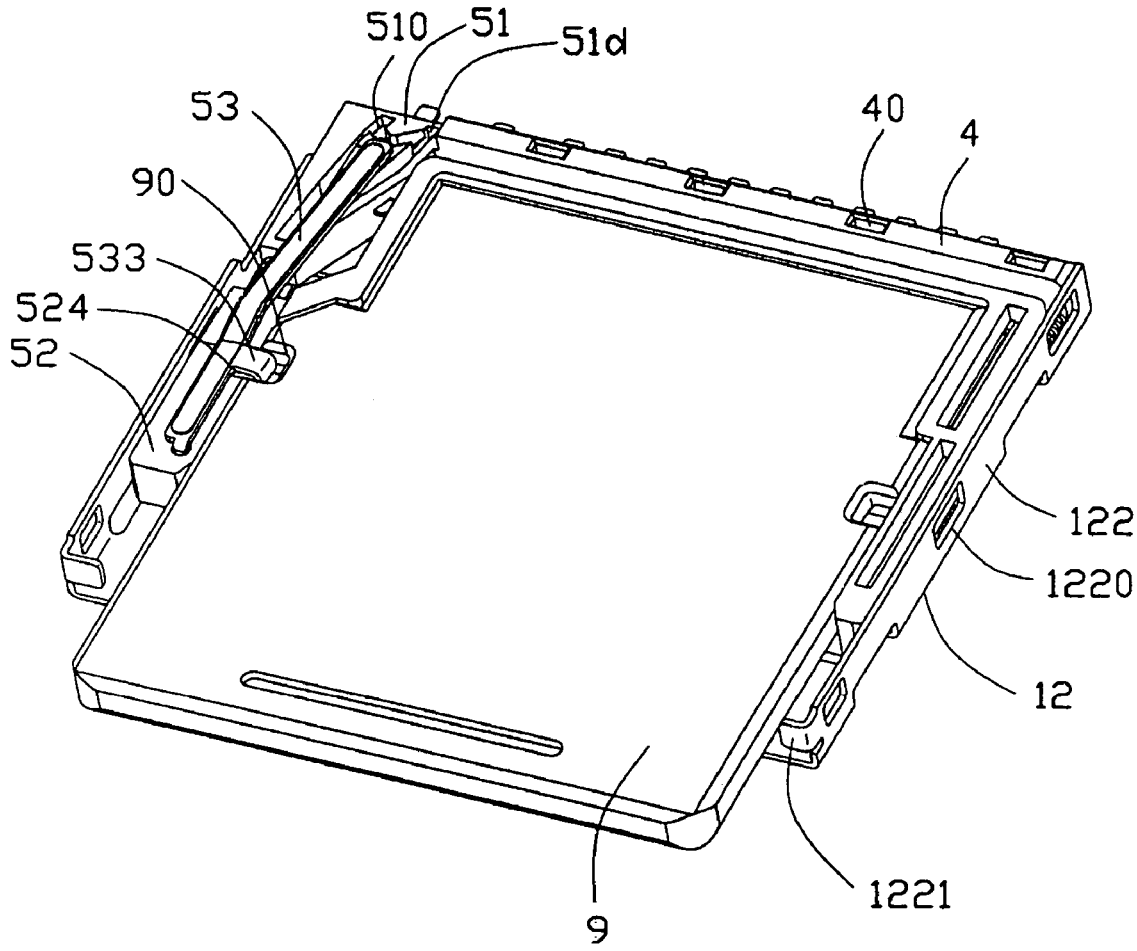
FIG. 8 is similar view of FIG. 7 but with the electrical card fully inserted into the connector.
Figure 9:
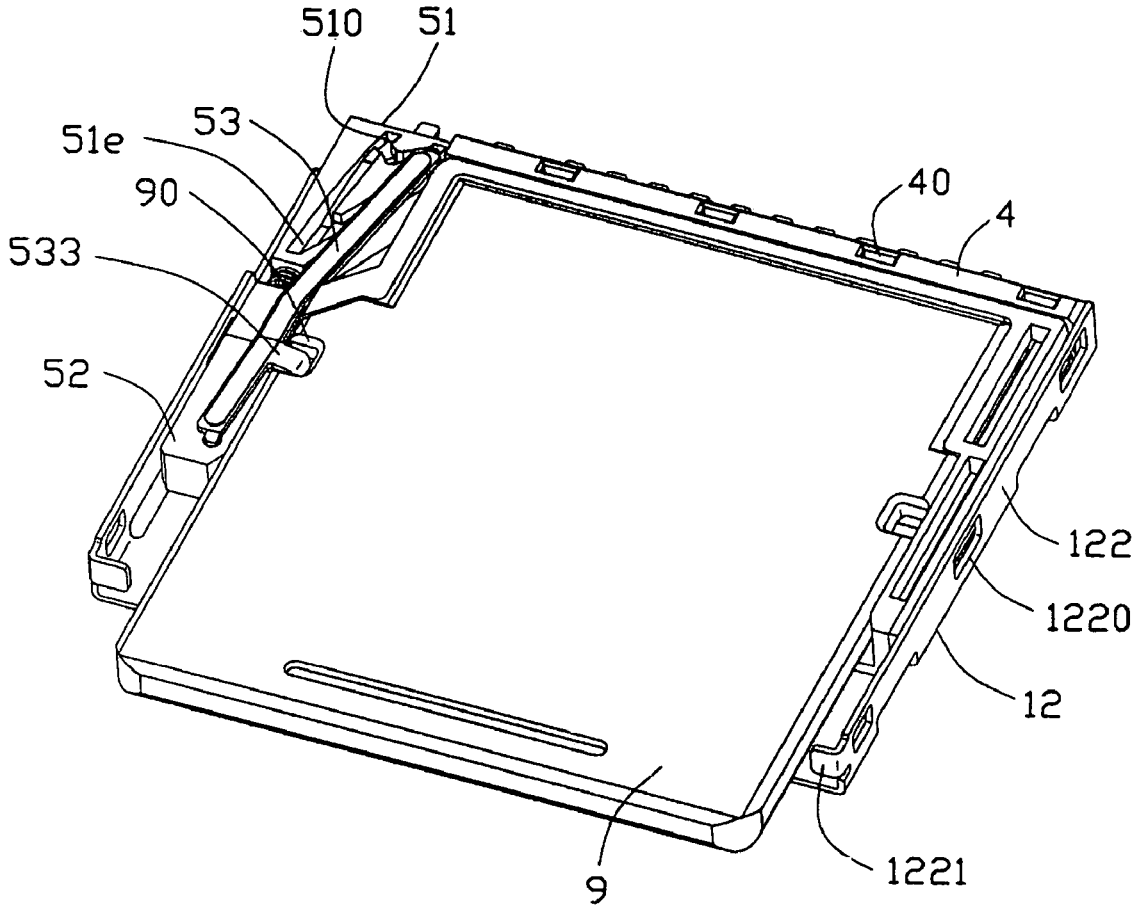
FIG. 9 is similar view of FIG. 7 but with the card initially ejected from the connector.

Referring to FIGS. 7–9, in use, the electrical card 9 is inserted into the receiving room 520 of the slider 52. When the electrical card 9 is inserted into the electrical card connector 100, the slider 52 and the cam follower 53 are pushed by the card 9 to move near side of the connector 100. When the slider 52 abuts against the resistance tabs 1221 of the bottom plate 12, the electrical card 9 is fully inserted into the connector 100 and the second hook 532 of the cam follower 53 is displaced in the first transition point 51*b* of the guiding groove 510 of the heart cam element 51. When the force exerted on the card 9 is released, as shown in FIG. 8, the second hook 532 of the cam follower 53 abuts against the middle point 51*c* of the guiding groove 510 of the heart cam element 51 via the elastic force recovery of the coiled springs 54. As a result, the clasp 533 of the cam follower 53 is appropriately inserted in the notch 90 of the electrical card 9 because of the movement of the cam follower 53, thereby locking the electrical card 9 in the connector 100 and preventing the card 9 from falling out of the connector 100 due to unexpected external forces. In the lock state, the electrical nods (not shown) of the electrical card 9 appropriately electrically connect with the contacting portions 21 of the conductive contacts 2, at the same time, the detect contacts 3 are pressed by the slider 52 to realize the detect function.

When the card 9 is pushed interiorly again, the second hook 532 of the cam follower 53 is positioned in the second transition 51*d* of the guiding groove 510 of the heart cam element 51. Then the slider 52 return to the initiative point 51*a* via the elastic force recovery of the coiled springs 54 (shown in FIG. 7). At the same time, the second hook 532 of the cam follower 53 is displaced in the terminate point 51*e* (51*a*). The clasp 533 of the cam follower 53 exits from the notch 90 of the card 9, thereby free the electrical card 9 from the connector 100. An external force exerted in the card 9 is released, the electrical card 9 is ejected the connector 100 (shown in FIG. 9).

Comparing to prior arts, the eject mechanism according to the present invention need not assemble additional latching member, thereby decreasing the produce and assembly process of latching member and simplifying the eject mechanism.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical card connector for electrically connecting with an electrical card defining a notch, comprising:

a cover having a top plate and a bottom plate, said bottom plate having a front resistance tab and a stopping flap;

a fixing member retained between the top and bottom plates;

a plurality of contacts supported by the fixing member; and an eject mechanism, comprising:

a heart cam element defining a guiding groove;

a slider for pressing the front resistance tab and the stopping flap, and being movable along the bottom plate between the front resistance tab and the stopping flap and;

a cam follower comprising one end pivotally connecting with the slider and another end movable along the guiding groove, the cam follower forming a clasp for releasably engaging with the notch of the electrical card; and a spring disposed between the slider and the heart cam element.

2. The electrical card connector according to claim 1, wherein the clasp of the cain follower is positioned on a generally middle potion thereof.

3. The electrical card connector according to claim 1, wherein said clasp is substantially L-shaped, and wherein the slider defines a recess for engaging with the clasp.

4. The electrical card connector according to claim 1, wherein the heart cam element is integrally formed with the fixing member and is positioned on one side of the fixing member.

5. The electrical card connector according to claim 1, wherein the stopping flap extends upwardly from a substantially middle portion of the bottom plate of the cover for pressing one end of the slider to restrict forward movement of the slider.

6. The electrical card connector according to claim 1, wherein the slider defines a receiving room for accommodating the electrical card and further includes on a front portion a comb structure defining a plurality of aligning slots therein to respectively receive corresponding contacts when said slider is moved together with the card and the cam follower in said insertion direction.

7. An electrical connector assembly comprising:

an electronic card defining a side notch therein; and an electrical card connector including:

an insulative housing retaining a plurality of contacts therein;

a front resistance tab:

a stopping flap:

an eject mechanism, comprising:

a cam element defining receiving groove defining inner and outer positions thereof in opposite insertion/ejection directions;

a slider for pressing the front resistance tab and the stopping flap, and being restricted to move between the front resistance tab and the stopping flap relative to the housing along said insertion/ejection directions; and a cam follower linked between said cam element and said slider, and moveable, together with the slider, relative to the cam element in said insertion/ejection directions, said cam follower forming a clasp which performs essentially transverse movements perpendicular to said insertion/ejection directions;

wherein under a condition that the card is received into the connector and moved together with the slider, the clasp is transversely moved to be received in the notch when said cam follower is located in the inner position for locking the card, and the clasp is transversely moved to be released from the notch when the cam follower is located in the outer position for unlocking the card.

8. The assembly as claimed in claim 7, wherein the slider further includes on a front portion a comb structure defining a plurality of aligning slots therein to respectively receive corresponding contacts when said slider is moved together with the card and the cam follower in said insertion direction.

9. The assembly as claimed in claim 7, wherein said cam element is formed on a side portion of the housing.

10. The assembly as claimed in claim 7, wherein said transverse movements are further perpendicular to, rather than parallel to, a vertical direction which is perpendicular to the insertion/ejection directions.

* * * * *